US008803593B2

(12) United States Patent
Al-Dahle et al.

(10) Patent No.: US 8,803,593 B2
(45) Date of Patent: Aug. 12, 2014

(54) VOLTAGE DISCHARGE OPTIMIZATION

(71) Applicant: Apple Inc., Cupertino, CA (US)

(72) Inventors: Ahmad Al-Dahle, San Jose, CA (US); Yafei Bi, Palo Alto, CA (US); Mir B. Ghaderi, Cupertino, CA (US); Wei H. Yao, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/632,078

(22) Filed: Sep. 30, 2012

(65) Prior Publication Data

US 2013/0229164 A1 Sep. 5, 2013

Related U.S. Application Data

(60) Provisional application No. 61/605,687, filed on Mar. 1, 2012.

(51) Int. Cl.
*G05F 1/10* (2006.01)

(52) U.S. Cl.
USPC ..... 327/540; 327/541

(58) Field of Classification Search
USPC ..... 327/427, 530, 535, 537, 538, 539, 540, 327/541, 543, 545, 546
See application file for complete search history.

(56) References Cited

U.S. PATENT DOCUMENTS

| | | | | |
|---|---|---|---|---|
| 4,097,753 | A | 6/1978 | Cook et al. | |
| 6,774,684 | B2 | 8/2004 | Wu et al. | |
| 6,819,083 | B1 | 11/2004 | Patino et al. | |
| 6,833,751 | B1 | 12/2004 | Atrash | |
| 7,095,219 | B2 | 8/2006 | Takemura et al. | |
| 7,436,338 | B2 | 10/2008 | Hales et al. | |
| 7,724,075 | B2 | 5/2010 | Yang et al. | |
| 7,839,203 | B1 * | 11/2010 | MacLean et al. | 327/540 |
| 2002/0121885 | A1 | 9/2002 | Taylor et al. | |
| 2009/0121912 | A1 | 5/2009 | Zanchi et al. | |
| 2011/0063021 | A1 * | 3/2011 | Yamashita et al. | 327/540 |

OTHER PUBLICATIONS

PCT/US2013/028414. International Search Report & Written Opinion. Jun. 21, 2013.

* cited by examiner

*Primary Examiner* — Lincoln Donovan
*Assistant Examiner* — Jung H Kim
(74) *Attorney, Agent, or Firm* — Womble Carlyle Sandridge & Rice LLP

(57) ABSTRACT

One embodiment of an apparatus to control and sense a voltage through a single node can include a comparator to monitor single node voltage, a transistor to discharge voltage through the single node and control logic. The control logic can have at least two operational phases when actively controlling the voltage through the single node. In a first phase, the control logic can configure the comparator to determine if the single node voltage is greater than a reference voltage. In a second phase, the control logic can configure the transistor to discharge voltage through the single node when the comparator has previously indicated that the single node voltage is greater than a reference voltage. The control logic can alternatively execute first and second phases to discharge the voltage to a predetermined level.

20 Claims, 7 Drawing Sheets

VOLTAGE DISCHARGE OPTIMIZATION

CROSS-REFERENCE TO RELATED APPLICATIONS

This application claims the benefit of U.S. Provisional Patent Application No. 61/605,687, filed Mar. 1, 2012 and entitled "VOLTAGE DISCHARGE OPTIMIZATION" by AL-DAHLE et al., which is incorporated by reference in its entirety for all purposes.

FIELD OF THE DESCRIBED EMBODIMENTS

The described embodiments relate generally to adjusting voltages within a circuit and more particularly to monitoring and adjusting a voltage through a single node.

BACKGROUND

Circuit operations often require a circuit node or network to be set to a predetermined voltage. For example, a signal from a first integrated circuit (IC) to a second IC may need to be set to a particular voltage level. Traditional circuit designs for voltage control can use at least two signals: one signal to control the voltage on a circuit node and a second signal dedicated to sense the voltage level of the circuit node. The second signal advantageously allows a continuous sensing of the circuit node. Continuous sensing can enable a faster convergence of a signal to a voltage level. The second signal can also enable remote sensing of voltage levels. Remote sensing can correct any errors that can come about due to such as process variation.

In some designs, each signal can increase cost and complexity. This is particularly true of some IC designs since every signal external to the IC can require a bond out through a ball or a pin. Along with the pin costs associated with IC packages, there are circumstances when an additional pin can force an IC design to be placed into a larger package. Larger packages can increase the cost of the IC substantially. Along with package costs, additional printed circuit resources may be required to support the signal (coupled to the pin), increasing printed circuit board design cost and complexity.

Therefore, what is desired is a way to set and control a voltage in a circuit while minimizing circuit complexity and reducing signals needed to implement the sense and control.

SUMMARY OF THE DESCRIBED EMBODIMENTS

This paper describes various embodiments that relate to adjusting voltages within a circuit.

According to an embodiment of the present invention, a method for setting a voltage level at a node with respect to a reference voltage during a voltage setting period wherein at least one capacitor is coupled to the node through one resistor, includes isolating the node from at least one voltage source. The method further includes evaluating the voltage at the node for a first time period and removing the charge from the at least one capacitor through the at least one resistor for a second time period. The comparing and removing is repeated as long as the sum of the repeated first and second time periods is less than the voltage setting period.

According to an embodiment of the invention, a method for setting a voltage level at a node with respect to a reference voltage during a voltage setting period includes isolating the node from at least one voltage source, evaluating the voltage level at the isolated node for a first time period, and sinking the voltage level at the isolated node for a second time period based on the evaluating.

According to an embodiment of the invention, a circuit for setting a voltage level at a node with respect to a reference voltage during a voltage setting period includes a plurality of remote nodes coupled to the node through at least one capacitor and at least one resistor, a switching device coupled between the node and ground potential, a comparator coupled to the reference voltage and the node, and control logic configured to receive an output of the comparator and controllably switch the switching device based on the received output during the voltage setting period.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION OF SELECTED EMBODIMENTS

Figure 1:
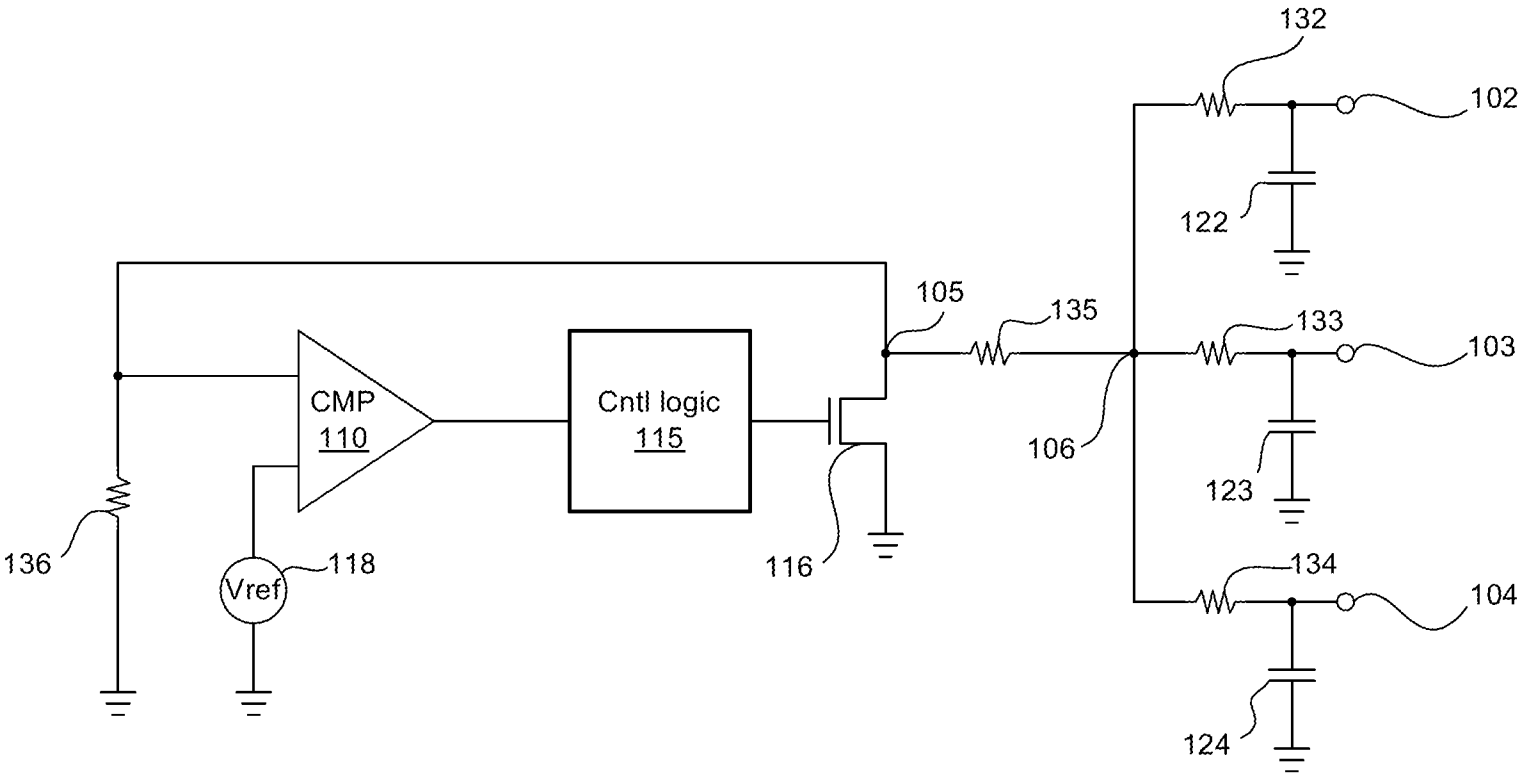
FIG. 1 is one embodiment of a circuit for setting a voltage though a single node.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Circuit networks can couple two or more nodes together and oftentimes it is desirous to control the voltage of the network. Common techniques for controlling a voltage can use at least two nodes. A first node can be used to source and control the voltage and a second node can be used to sense the network voltage. The sensed voltage can be fed back into a closed loop voltage controlling circuit. While this technique is straight forward, the technique requires at least two nodes. In some designs, the number of nodes can increase design cost and complexity by, among other things, increasing packaging costs (of, for example, integrated circuits) and/or printed circuit design complexity.

An alternative to a multiple node approach can use a single node. In one embodiment, control logic can alternatively sense a voltage level and adjust the voltage level through the single node. In one embodiment, the voltage level is not adjusted in a single operation, but rather is adjusted in steps where the voltage level is allowed to approach a reference voltage by iteratively sensing and adjusting the voltage level. The sum of the iterative sensing and adjusting periods can be less than a voltage settling period.

In one embodiment, voltage adjustment can be one-sided in that the sensed voltage prior to adjustment is expected to have a particular bias with respect to a reference voltage. For example, prior to adjusting the voltage of a node, the node is expected to have a voltage potential greater than the reference voltage. In other embodiments, a one sided adjustment can begin with the voltage of a node as less than a reference voltage. One sided adjustments can enable simplified voltage adjustment circuits since voltages are only expected to move in one direction (i.e., voltages are expected to only increase or decrease).

FIG. 1 is one embodiment of a circuit 100 for setting a voltage though a single node. The circuit 100 can include remote nodes 102, 103 and 104, control logic 115 and comparator 110. A capacitance 122 can be coupled to remote node 102. Similarly, capacitance 123 can be coupled to remote node 103 and capacitance 124 can be coupled to node 104. Resistance 132 can couple remote node 102 to common node 106. Similarly, resistance 133 can couple remote node 103 to common node 106 and resistance 134 can couple remote node 104 to common node 106. Resistance 135 can couple common node 106 to monitoring node 105. In one embodiment remote nodes 102-104 can be coupled to other circuits such as voltage sources, current source or the like (not shown here). Prior to setting voltage levels through circuit 100, circuit 100 should be isolated from other voltage or current sources.

N-channel field effect transistor (n-FET) 116 can be coupled to monitoring node 105 and ground. The gate of n-FET 116 can be coupled to control logic 115. In other embodiments, n-FET 116 can be replaced with other similar devices such a p channel FETs, NPN transistors, PNP transistors or any other technically suitable component. In this embodiment, n-FET 116 can be used to draw down the voltage of the remote nodes 102-104. Comparator 110 can compare the voltage of monitoring node 105 to reference voltage 118. Although reference voltage 118 is shown here as a voltage source, in other embodiments, reference voltage 118 can be a programmable voltage source that can be set through software, firmware, a processor or other means. Monitoring node 105 can be coupled to ground through resistor 136. Output of comparator 110 can be coupled to control logic 115.

Control logic 115 can operate to control the voltages on remote nodes 102-104 by drawing down on the voltages through n-FET 116. In the embodiment illustrated in FIG. 1, voltages at remote nodes 102-104 can be greater in potential than reference voltage 118. This can be referred to as a one-sided voltage adjustment since the voltages at the remote nodes 102-104 are expected to be greater than reference voltage 118 (in contrast to expecting voltage at remote nodes 102-104 sometimes above and sometimes below reference voltage 118). In other embodiments, the voltages at remote nodes 102-104 can be lower in potential than reference voltage 118 (this can be another example of a one-sided voltage adjustment). A simple adjustment to n-FET 116 can accommodate different relationships between voltages at remote nodes 102-104 and reference voltage 118. In one embodiment, the source of n-FET can be referenced to a different voltage (other than ground). In another embodiment, n-FET can be replaced with a p-FET.

Figure 2:
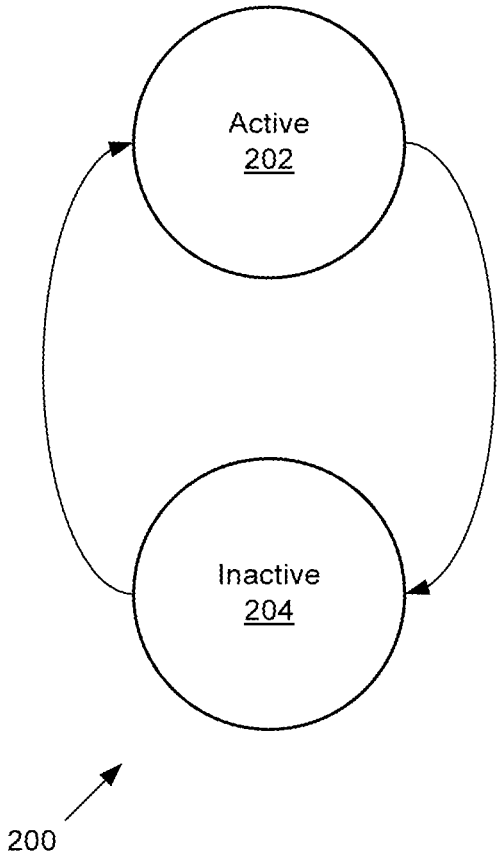
FIG. 2 is a state diagram of the operational states of control logic, in accordance with the specification.

FIG. 2 is a state diagram 200 of the operational states of control logic 115 in accordance with the specification. Control logic 115 can operate in active state 202. When in active state 202, control logic 115 operates to drive voltage at remote nodes 102-104 to reference voltage 118. In one embodiment, control logic 115 can operate to drive voltage at remote nodes 102-104 to reference voltage 118, within a tolerance range, for example 10 mV. The operational state of control logic 115 can transition to inactive 204. In inactive state 204, control logic 115 is quiescent. The operation state can return to active 202. The selection of operational states can be controlled by external logic, firmware, processor or the like. In one embodiment, the operational state can determined by a signal coupled to control logic 115.

Control logic 115 can control voltages at remote nodes by alternately monitoring voltage at monitoring node 105 and discharging current through monitoring node 105. This arrangement advantageously uses only a single node to both sense and control remote voltages. In one embodiment, current is discharged though n-FET 116.

Figure 3:
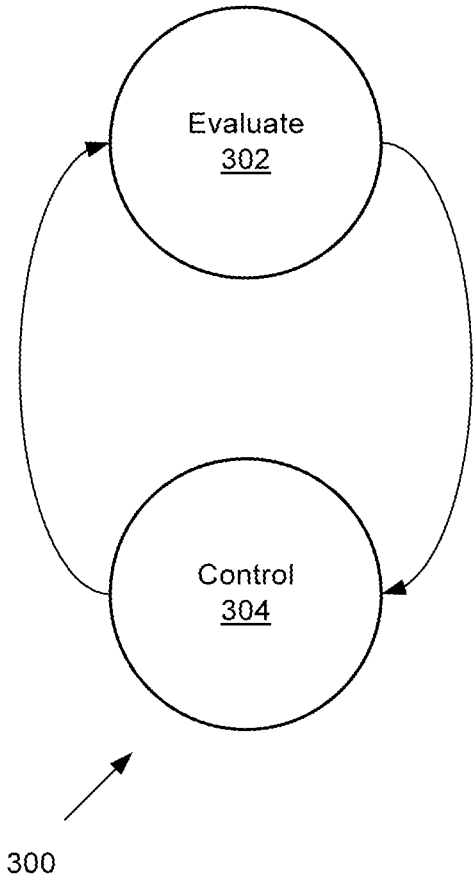
FIG. 3 is a state diagram of phases of the active state of control logic, in accordance with the specification.

FIG. 3 is a state diagram 300 of phases of active state 202 of control logic 115, in accordance with the specification. In evaluate phase 302, n-FET 116 can be biased off (in this embodiment, gate voltage of n-FET 116 can be less than a threshold voltage). Comparator 110 can compare a voltage at monitoring node 105 to reference voltage 118. Comparator 110 can indicate to control logic 115 when the monitoring node 105 voltage is greater than reference voltage 118. Data from comparator 110 can be stored in control logic 115 for use in control phase 304. In control phase 304, control logic 115 can bias n-FET 116 on when the data from comparator 110 has indicated that monitoring node 105 is greater than reference voltage 118. During control phase 304, output data from comparator 110 can be ignored.

When control logic 115 is in control phase 304 and n-FET 116 are on, current travels through monitoring node 105 and is coupled to ground. In this embodiment, current stored in capacitance 122-124 can be routed through resistances 132-134 and resistance 135. Because of the different resistances (resistances 132-134 and resistance 135 are not necessarily similar because of, for example, process variation); current induced voltages at remote nodes 102-104 or voltages at resistances 132-134 can be different. These different voltages can result in erroneous voltage setting, especially since only monitoring node 105 is monitored; no voltage information from remote nodes 102-104 is sensed. During evaluation phase 302, since n-FET 116 is off, currents can settle to a steady state. Some charge can redistribute between capacitances 122-124. In this way, voltages at remote nodes 102-104 can be more accurately reflected at monitoring node 105.

Thus, by alternating phases between evaluation phase 302 and control phase 304, voltages at remote nodes 102-104 can be set through a single node (i.e., monitoring node 105). The amount of time that control logic 115 can be in either evaluation 302 or control 304 phase can be configured in hardware, software, firmware or the like. In one embodiment, the time for evaluation 302 and control 304 phases can be programmable. In another embodiment, the time allowed for control phase 304 can be determined by a resistor-capacitor (RC) time constant, as viewed from monitoring node 105. As is well-known, a voltage can substantially decay through a resistor-capacitor network within five RC time constant periods. Thus, setting the time period of control phase 304 to one RC time constant can ensure that the initial cycle of n-FET 116 is short enough so as not to overshoot the reference voltage 118 (reduce the voltage at remote nodes 102-104 by too great an amount). Similarly, the time allowed for evaluation phase 302 can be set to one RC time constant. This should allow ample time for the currents to redistribute and voltages to come to a steady state where the voltage at monitoring node 105 can substantially match voltages at remote nodes 102-104.

Figure 4:
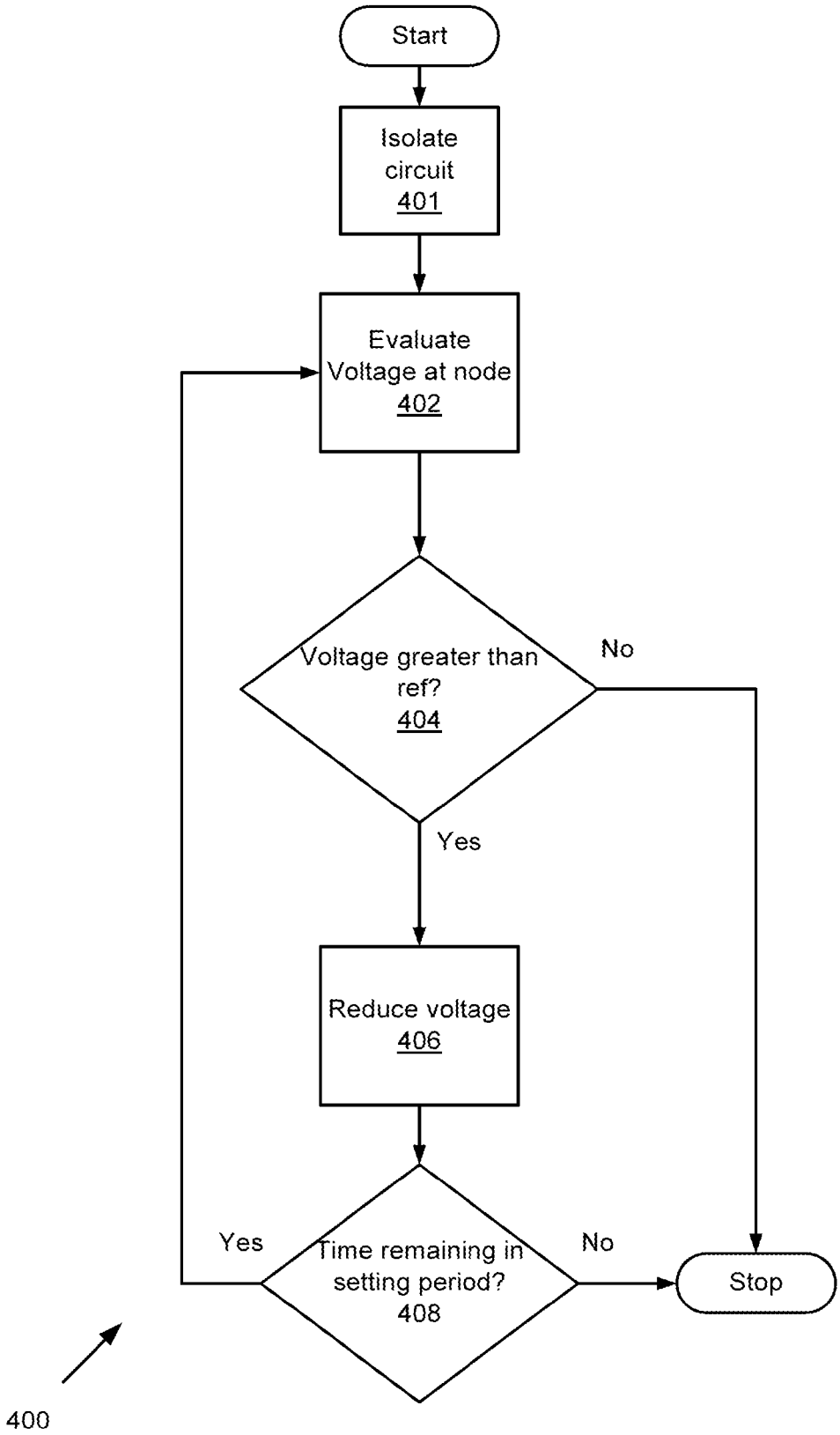
FIG. 4 is a flowchart of method steps for controlling a voltage in circuit through a single node.

FIG. 4 is a flowchart of method steps 400 for controlling a voltage in a circuit through a single node. Those skilled in the art will recognize that any system configured to perform the method steps in any order is with the scope of the specification. The method begins in step 401 when the circuit is isolated. Circuits can often be driven by two or more sources, such as voltage sources. In one embodiment, prior to controlling the circuit voltage, other sources can be disabled and thereby isolate the circuit. In step 402 a voltage is evaluated. In the embodiment of FIG. 1, the voltage at monitoring node 105 is evaluated for a first time period. In step 404, evaluated voltage is compared to a reference voltage. In one embodiment, the reference voltage can include a tolerance amount above and below the reference voltage. In the embodiment of FIG. 1, voltage of monitoring node 105 is compared to reference voltage 118. If evaluated voltage is not greater than reference voltage, then the method stops. On the other hand, if evaluated voltage is greater than reference voltage then in step 406 voltage is reduced. In the embodiment of FIG. 1, voltage is reduced by biasing n-FET 116 on and sinking current through monitoring node 105 to ground for a second time period. In step 408 if the sum of the first and second periods is less than a voltage setting period, then the method returns to step 402. In one embodiment, the method steps 402, 404, 406 and 408 can be repeated multiple times. In such cases, the sum of all executed first and second periods is combined and compared to the voltage setting period. On the other hand, if the sum of the first and second periods is greater than the voltage setting period, the method stops.

Figure 5:
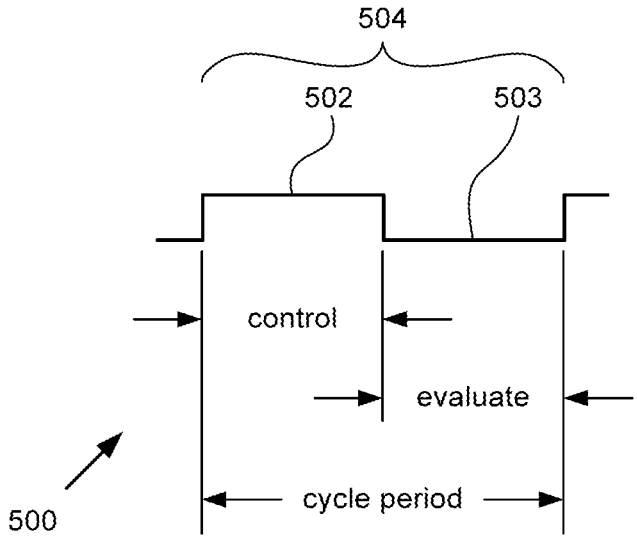
FIG. 5 shows a timing diagram of phases of control logic in an active state, in accordance with the specification.

FIG. 5 shows a timing diagram 500 of phases of control logic 115 in active state 302. The time for control phase 304 is indicated as time 502. In one embodiment, time 502 can be an RC time constant of a circuit as seen from monitoring node 105. In another embodiment, time 502 can be programmable through firmware, software or the like. Time for evaluation phase 302 is indicated as time 503. In one embodiment time 503 can be one RC time constant. In another embodiment, time 503 can be determined by bench characterization of circuits. In another embodiment, time 503 can be programmable through firmware, software or the like. Time 504 represents the time required for an evaluation/control cycle.

Figure 6:
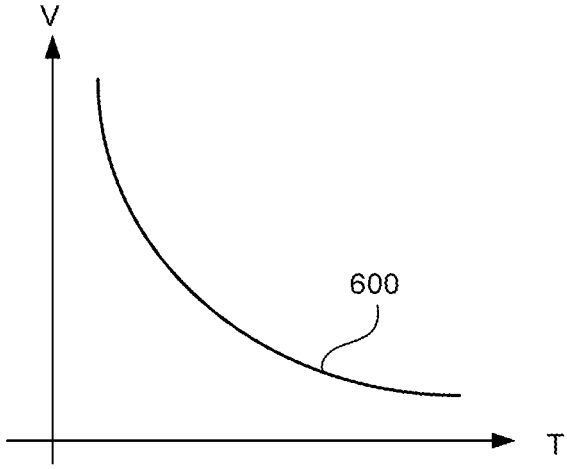
FIG. 6 shows a voltage curve in accordance with the specification.
Figure 7:
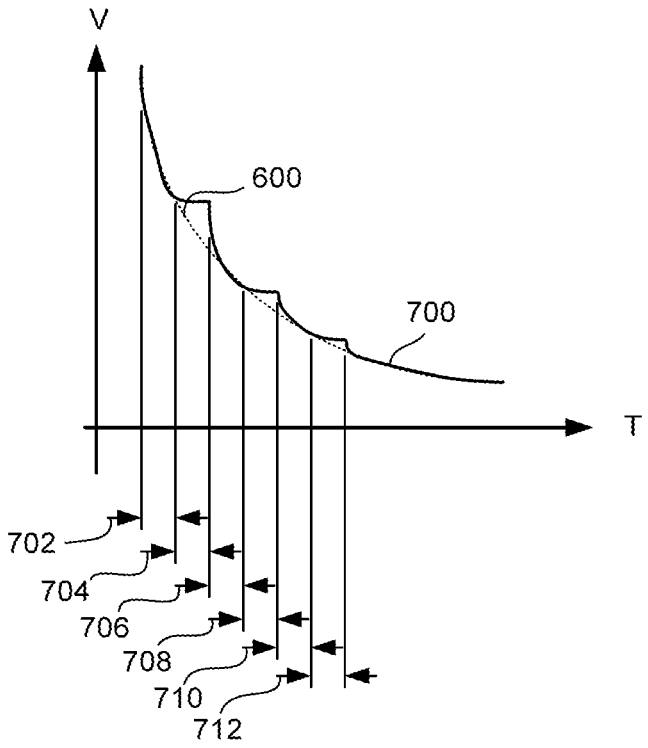
FIG. 7 shows another voltage curve, in accordance with the specification.

FIG. 6 shows voltage curve 600. Curve 600 can reflect a voltage decay that can occur as voltage dissipates through a resistor-capacitor (RC) circuit. The shape of curve 600 can be determined, to some extent, by an RC time constant. In contrast, FIG. 7 shows another voltage curve 700. Curve 700 can reflect voltage as seen at monitoring node 105 while control logic 115 is in active state 202. Voltage curve 600 is superimposed and shown as a dotted line. While control logic 115 is in control phase 304, n-FET 116 conducts and voltage on monitoring node 105 is reduced. This voltage reduction is shown on curve 700 during time period 702. When control logic 115 is in evaluation phase 302, n-FET 116 is off and voltages on remote nodes 102-104 and monitoring node 105 can settle. This is shown on curve 700 during time period 704. Curve 700 shows changes in voltage of monitoring node 105 as control logic 115 alternates between control phase 304 and evaluation phase 302. Time periods 706 and 710 can be related to control phase 304 and time periods 708 and 712 can be related to evaluation phase 302. In one embodiment, a voltage setting period can be a time period allotted to set the voltage of a circuit. In one embodiment, control phase 304 and evaluation phase 302 time periods can be related to an RC time constant. Setting control 304 and evaluation 302 phase time periods to an RC time constant can help ensure that several iterations of control 304 and evaluation 302 phases can be completed as the circuit voltage is reduced (or increased) to approach and not exceed reference voltage 118. In one embodiment, a voltage setting period can include two or more control 304 and evaluation 302 phases.

Figure 8:
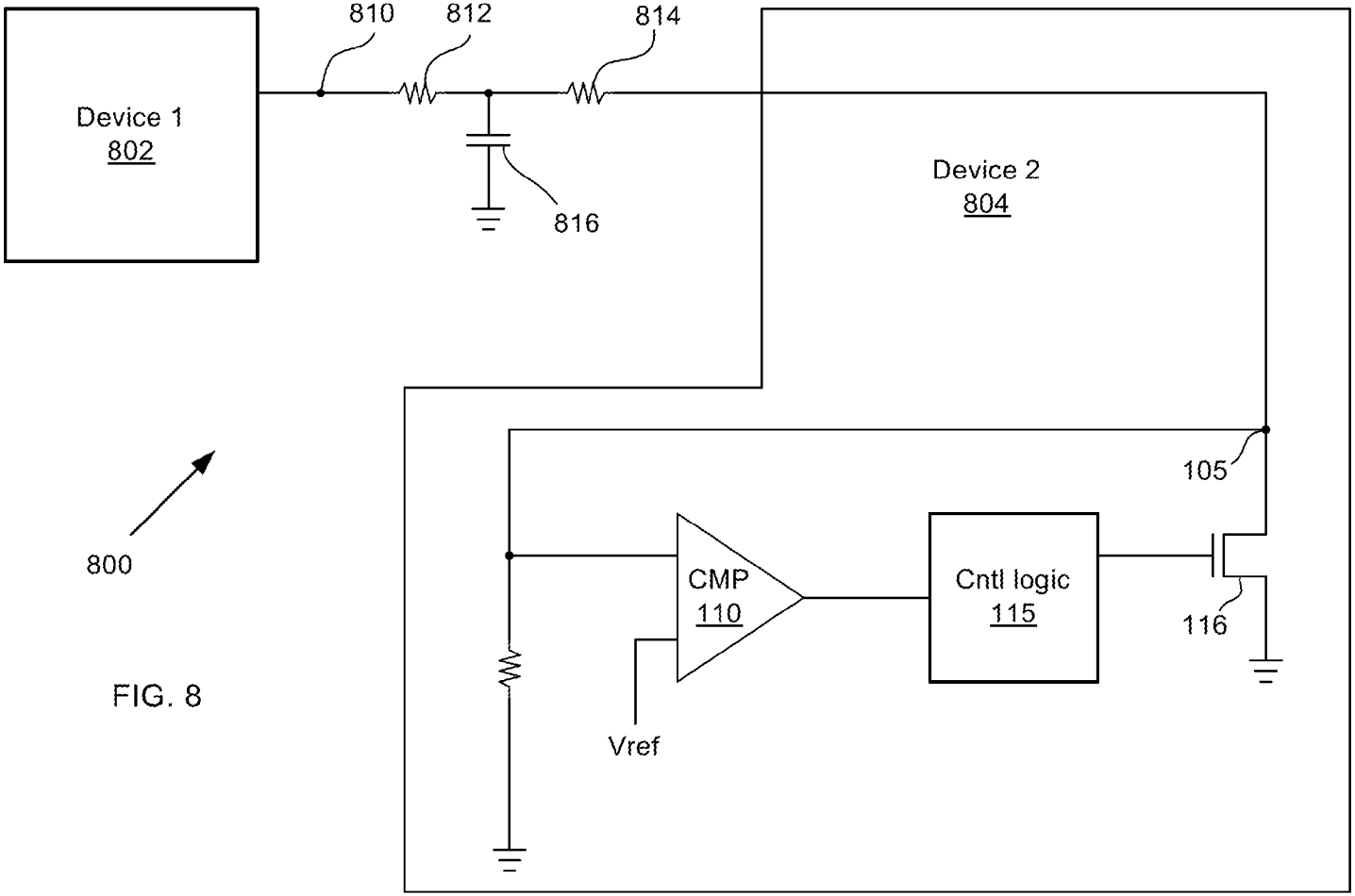
FIG. 8 is one embodiment of a system to control remote voltages in accordance with the specification.

FIG. 8 is one embodiment of a system to control remote voltages 800 in accordance with the specification. The system can include first device 802, second device 804, first resistance 812, second resistance 814, capacitance 816, control logic 115, n-FET 116, comparator 110 and monitoring node 105. Remote node 810 can be coupled to first device 802 and resistance 812. As shown, comparator 110, control logic 115, monitoring node 105, and n-FET 116 can be incorporated into second device 804. In another embodiment, these components can be incorporated into other devices. In yet another embodiment, these components can be discrete and separate from first device 802 and second device 804. When control logic 115 is in an inactive state 204, then n-FET 116 can be biased off and comparator 110 outputs can be ignored. When control logic 115 is in active state 202, in control phase 304, first device 802 can isolate node 810 by tri-stating any driving circuitry coupled to remote node 810, and n-FET 116 can be biased on and voltage on monitoring node 105 can be reduced as current is coupled from monitoring node 105 to ground. Isolating node 810 can enable second device 804 to control voltage through monitoring node 105 without first device 802 interfering In one embodiment, current from capacitance 816 can be moved through resistance 814, through monitoring node 105 to ground by n-FET 116. Continuing in active state 202, in evaluation phase 302, comparator 110 can compare voltage of monitoring node 105 with reference voltage 118 and can output a signal to control logic 115 when monitoring node 105 is greater than reference voltage 118. In another embodiment, comparator 110 can output a signal to control logic 115 when monitoring node 105 is less than reference voltage 118. The comparator 110 output signal can be captured in control logic 115 for use in control phase 304 to determine when to bias on n-FET 116.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line.

The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A method comprising:

setting voltage levels at a plurality of remote nodes with respect to a reference voltage during a voltage setting period, wherein each of the plurality of remote nodes is coupled to a common node through at least one resistor and is configured to be between the at least one resistor and at least one capacitor, wherein the setting comprises:

isolating the common node and the plurality of remote nodes from at least one voltage source;

evaluating a voltage level at the isolated common node for a first time period, wherein the first time period is sufficient for charge redistribution that enables the voltage level at the common node to more accurately reflect the voltage levels at the plurality of remote nodes; and removing charge from the at least one capacitor through the at least one resistor for a second time period based on the evaluating;

wherein the evaluating and removing is repeated as long as the sum of the repeated first and second time periods is less than the voltage setting period.

2. The method of claim 1, wherein isolating the common node and the plurality of remote nodes comprises:

disabling the at least one voltage source.

3. The method of claim 2, wherein disabling the at least one voltage source comprises:

tri-stating driving circuitry associated with the at least one voltage source.

4. The method of claim 1, wherein evaluating the voltage level comprises:

comparing the voltage level at the common node to the reference voltage during the first time period.

5. The method of claim 4, wherein the comparing is facilitated through a comparator in operative communication with the common node and the reference voltage.

6. The method of claim 1, wherein the reference voltage is a voltage of a reference voltage source.

7. The method of claim 1, wherein removing the charge comprises:

sinking the voltage level at the common node for a portion of the second time period if the voltage level at the common node is greater than the reference voltage.

8. The method of claim 7, wherein sinking the voltage level comprises:

controllably directing a transistor to couple the common node to ground potential.

9. The method of claim 1, wherein removing the charge comprises:

grounding the voltage level at the common node for a portion of the second time period if the voltage level at the common node is greater than the reference voltage.

10. The method of claim 9, wherein grounding the voltage level comprises:

controllably directing a transistor to couple the common node to ground potential.

11. A method comprising:

setting voltage levels at a plurality of remote nodes with respect to a reference voltage during a voltage setting period, wherein each of the plurality of remote nodes is coupled to a common node through at least one resistor, wherein the setting comprises:

isolating the common node and the plurality of remote nodes from at least one voltage source;

evaluating a voltage level at the isolated common node for a first time period, wherein the first time period is sufficient for charge redistribution that enables the voltage level at the common node to substantially match the voltage levels at the plurality of remote nodes; and sinking the voltage level at the common node for a second time period based on the evaluating.

12. The method of claim 11, wherein the evaluating and sinking is repeated as long as the sum of the repeated first and second time periods is less than the voltage setting period.

13. The method of claim 11, wherein isolating the common node and the plurality of remote nodes comprises:

disabling the at least one voltage source through tri-stating driving circuitry associated with the at least one voltage source.

14. The method of claim 11, wherein evaluating the voltage level comprises:

comparing the voltage level at the common node to the reference voltage during the first time period.

15. The method of claim 14, wherein the comparing is facilitated through a comparator in operative communication with the common node and the reference voltage.

16. The method of claim 11, wherein the reference voltage is a voltage of a reference voltage source.

17. The method of claim 11, wherein each of the plurality of remote nodes is configured to be between the at least one resistor and at least one capacitor, and wherein sinking the voltage level at the common node comprises:

removing charge from the at least one capacitor through the at least one resistor for a portion of the second time period if the voltage level at the common node is greater than the reference voltage.

18. The method of claim 17, wherein removing the charge comprises:

controllably directing a transistor to couple the common node to ground potential.

19. The method of claim 11, wherein each of the plurality of remote nodes is configured to be between the at least one resistor and at least one capacitor, and wherein sinking the voltage level at the common node comprises:

grounding the voltage level at the common node for a portion of the second time period if the voltage level at the common node is greater than the reference voltage.

20. The method of claim 19, wherein grounding the voltage level comprises:

controllably directing a transistor to couple the common node to ground potential.

* * * * *